United States Patent [19]

Stuckey et al.

[11] Patent Number: 4,810,174

[45] Date of Patent: Mar. 7, 1989

[54] MOTOR AND PUMP ASSEMBLY

[75] Inventors: Buddy S. Stuckey, Fort Wayne; Roy L. Merkling, Jr., Kendallville; Owen W. Sherwin, Fort Wayne, all of Ind.

[73] Assignee: Flint & Walling, Inc., Kendallville, Ind.

[21] Appl. No.: 173,013

[22] Filed: Mar. 21, 1988

Related U.S. Application Data

[63] Continuation of Ser. No. 940,568, Dec. 12, 1986, abandoned.

[51] Int. Cl.[4] ..... F04B 17/00

[52] U.S. Cl. ..... 417/423.14; 415/DIG. 3

[58] Field of Search ..... 417/423 R, 423 G, 360, 417/410, 423 T; 415/DIG. 3

[56] References Cited

U.S. PATENT DOCUMENTS

| | | | |
|---|---|---|---|
| 2,386,508 | 10/1945 | Ripley | 417/423 T |
| 2,858,768 | 11/1958 | Gaylord, Jr. et al. | 417/423 R |
| 2,999,629 | 9/1961 | Soumerai . | |
| 3,034,443 | 5/1962 | Hinrichs et al. . | |
| 3,138,105 | 6/1964 | White | 417/423 R |
| 3,333,544 | 8/1967 | Turk | 417/423 T |
| 3,411,450 | 11/1968 | Clitton | 417/360 |
| 3,526,469 | 9/1970 | Lipe et al. | 417/360 |
| 3,542,496 | 11/1970 | Bergeson | 417/423 R |
| 3,897,178 | 7/1975 | Palluch . | |
| 4,078,409 | 3/1978 | Kurokawa | 417/423 R |
| 4,105,371 | 8/1978 | Savage et al. . | |
| 4,306,841 | 12/1981 | Morrison et al. . | |
| 4,311,440 | 1/1982 | Eberhardt | 417/360 |
| 4,398,872 | 8/1983 | Fleenor et al. . | |

*Primary Examiner*—Carlton R. Croyle
*Assistant Examiner*—Timothy S. Thorpe
*Attorney, Agent, or Firm*—Edgar A. Zarins; Steven L. Permut; Leon E. Redman

[57] ABSTRACT

A motor and pump assembly having an intermediate mounting bracket adapted to conveniently join and support the separate motor housing and pump housing. The bracket is configured to accommodate the mounting of either a partial motor or a full motor design to the pump assembly. In the partial motor assembly, the mounting bracket is combined with a bearing housing to form the end wall of the motor housing and the support bearings for the motor shaft which extends therethrough into the pump assembly. Conversely, the bracket may be used to connect the pump to a full motor having an end wall structure. Thus, the mounting bracket may be combined with a partial motor during initial assembly and subsequently connect to a full motor upon failure of the partial motor.

19 Claims, 3 Drawing Sheets

MOTOR AND PUMP ASSEMBLY

This is a continuation of application Ser. No. 940,568 filed on Dec. 12, 1986, now abandoned.

BACKGROUND OF THE INVENTION

I. Field of the Invention

This invention relates to motor and fluid pump assemblies and, in particular, to an intermediate bracket adapted to mount the pump assembly housing to the motor assembly housing having a motor shaft extending therefrom to drive the pump impeller.

II. Description of the Prior Art

Fluid flow pumps have in the past generally comprised a pump assembly drivably connected to a motor assembly. Generally, both assemblies are disposed within separate housings in order to prevent the fluid from damaging the motor assembly. Oftentimes, both the housings are integrally joined with the motor shaft extending through a partition formed between the assemblies in order to drive the pump. However, with such a construction, upon failure of either the motor or the pump the entire assembly must be replaced. In order to minimize replacement costs, most modern assemblies include separable housings such that either the motor or pump can be independently repaired or replaced.

In order to reduce manufacturing and assembly costs for such pump and motor combinations, a partial motor design was developed to replace the conventional full motor. The full motor incorporates a fully enclosed housing and as such is capable of operating as a separate device. However, when combined in a motor and pump assembly, the full motor increases production costs by causing a duplication of parts, particularly in the housing structure. In contrast, the partial motor design eliminates the common interior wall between the motor assembly and the pump. In such a manner, similar housings may be utilized with different motors while final assembly can be deferred until the pump and motor are connected. Further cost reduction can be realized by utilizing a plastic bearing housing which forms, at least partially, the end wall of the motor housing while retaining the bearings which support the motor shaft. However, because of the direct connection between the motor and pump, upon failure of the motor the entire pump and motor assembly must be replaced even though the pump is in working order. Moreover, the pump and bracket of the partial motor cannot be connected to a full motor assembly because of the differing structures of the two designs.

SUMMARY OF THE INVENTION

The present invention overcomes the disadvantages of the prior known motor and pump assemblies by providing a mounting bracket adapted to connect a conventional pump to either a partial motor design or a full motor design.

The preferred motor and pump assembly of the present invention comprises a partial motor design having a mounting bracket and bearing housing forming the end wall of the motor housing. As is well known, the pump assembly is connected to the mounting bracket with the motor shaft drivably connected to the pump impeller. The bracket includes means for connecting the bracket to the bearing housing, an outer rabbet to receive the annular housing wall of the motor assembly, and an inner rabbet for receiving the bearing housing. The bearing housing and bracket are secured to the motor housing. In addition, the bearing housing is provided with a pair of enclosed recesses which receive and retain the heads of bolts adapted to mount the motor and pump assembly to its base. The recesses prevent the bolts from rotating during attachment of the base.

In the event of a failure of the partial motor, a conventional full motor may be purchased by the user for attachment to the bracket and pump. An example of a full motor is the National Electrical Manufacturer's Association Model J (NEMA J) pump motor which is readily obtainable as an independent component. Upon removal of the bracket and bearing housing from the non-functioning partial motor assembly, the bearing housing is separated from the mounting bracket. Thereafter, the bracket and pump can be readily secured to the full motor housing with the motor shaft extending through the bracket to drivably engage the pump impeller. In addition, the entire construction may be mounted to the support base.

Thus, the bracket of the present invention includes mounting configurations which allows it to be used with either the partial or full motor design. Whereas the partial motor design is preferred in order to reduce initial manufacturing and assembly costs, by adopting the bracket for connection to a full motor the user is able to replace the motor assembly with the readily available full motor while utilizing the pump and bracket of the original assembly.

Other objects, features, and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views, and in which.

DETAILED DESCRIPTION OF A PREFERRED EMBODIMENT OF THE PRESENT INVENTION

Figure 1:
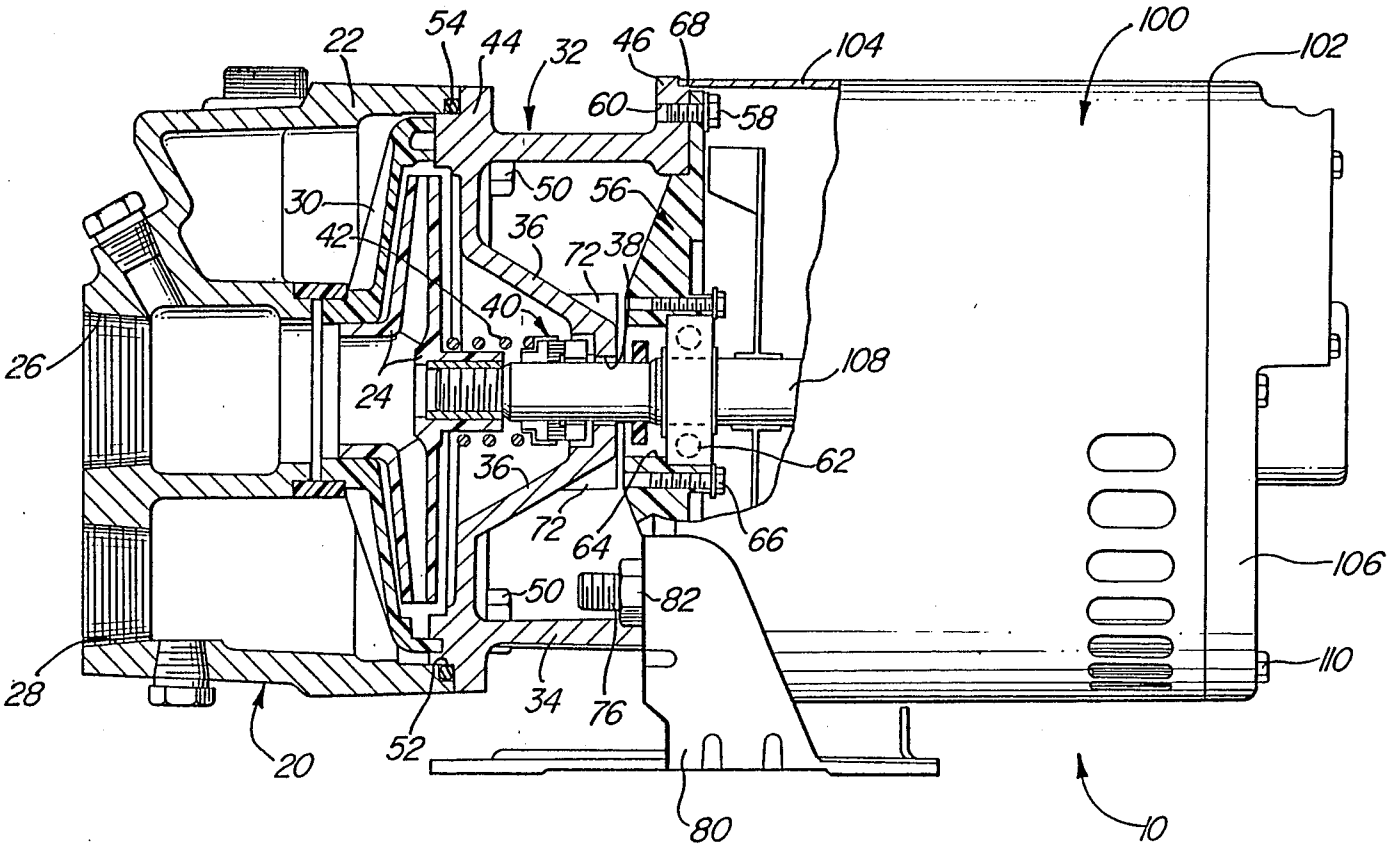
FIG. 1 is a perspective view, partially in section, of a partial motor and pump assembly embodying the present invention.
Figure 2:
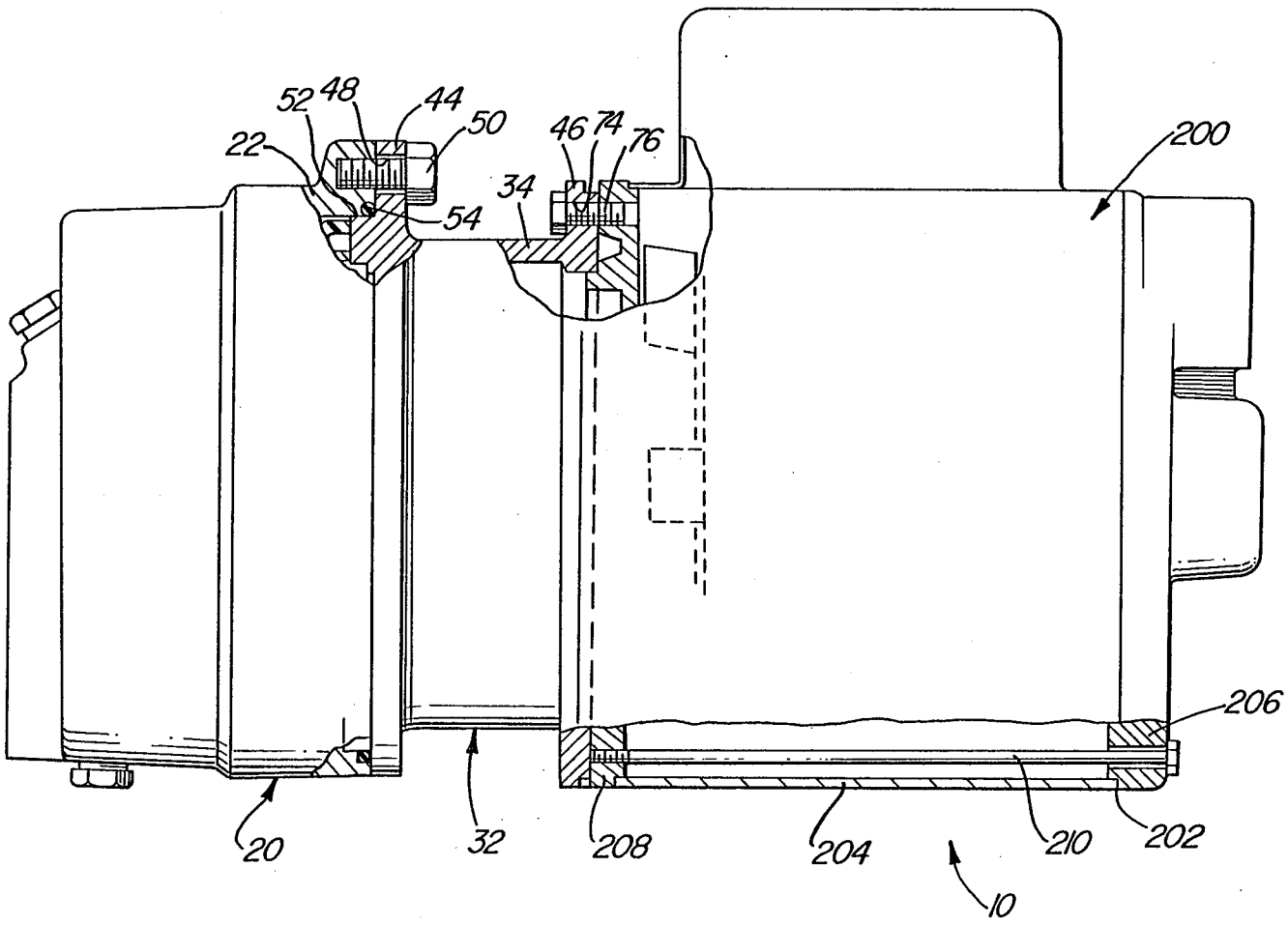
FIG. 2 is a perspective view, partially in section, of a full motor and pump assembly embodying the present invention.

Referring first to FIGS. 1 and 2 of the drawings, there is shown a motor and pump assembly 10 in accordance with the present invention. FIG. 1 shows the present invention in conjunction with a partial motor assembly 100, commonly referred to as a uni-frame motor assembly. In contrast, FIG. 2 shows the present invention in conjunction with a full motor assembly 200, such as a NEMA-J motor assembly designed to be utilized with pump assemblies of the type detailed herein. Both motor types are well known in the art and are generally differentiated by the end construction of the motor housing intermediate the pump. The partial motor assembly 100 (FIG. 1) is normally acquired with the pump pre-attached. Because the pump and motor are assembled and to reduce manufacturing costs, the intermediate wall between the pump and motor is eliminated and only a bearing housing is provided to maintain the rotor shaft. Thus, upon removal of the pump assembly the rotor shaft will be unsupported. For this reason, partial motor assemblies 100, by themselves, are not sold and upon failure of the motor the user must replace the entire pump and motor assembly. In contrast, the full motor assembly 200 can be separately purchased as a replacement motor. The full motor assembly 200 includes an end housing wall to retain and support the rotor shaft of the motor. Hence the term "full" motor assembly as opposed to the "partial" motor assembly which does not include the end wall. However, prior to the present invention the partial and full motor assemblies could not be interchangeably utilized with the same pump because of the different mounting configurations. It is to be understood that the present invention may be interchangeably utilized with either the partial motor assembly 100 or the full motor assembly 200 as will be described in greater detail.

In addition to one of the motor assemblies 100 or 200, the motor and pump assembly 10 comprises a pump assembly 20 having a pump housing 22 with a rotatable pump impeller 24 mounted therein. The pump housing 22 includes an inlet port 26 and an outlet port 28 through which the fluid is directed by the pump impeller 24. Also disposed within the pump housing 22 is a flow diffuser 30.

In order to maintain the position of the impeller 24 within the pump housing 22 and to connect the pump assembly 20 to one of either the partial motor assembly 100 (FIG. 1) or the full motor assembly 200 (FIG. 2), an intermediate mounting bracket 32 is provided in accordance with the present invention. The mounting bracket 32, as shown in detail in FIG. 3, comprises an annular mounting ring 34 integrally formed with a central support hub 36. The support hub 36 has a substantially frusto-conical cross-section with a central opening 38 adapted to receive the drive shaft of the motor assembly. The support hub 36 is frusto-conical in order to provide room for the mounting assembly of the pump impeller 24 including a seal assembly 40 and a seal assembly biasing spring 42 which extend between the support hub 36 and the rotatable impeller 24 of the pump assembly 20. Thus, upon mounting of the pump assembly 20 to the mounting bracket 32, the pump impeller 24 is positionally maintained within the pump housing 22 by the drive shaft of the motor assembly.

Figure 3:
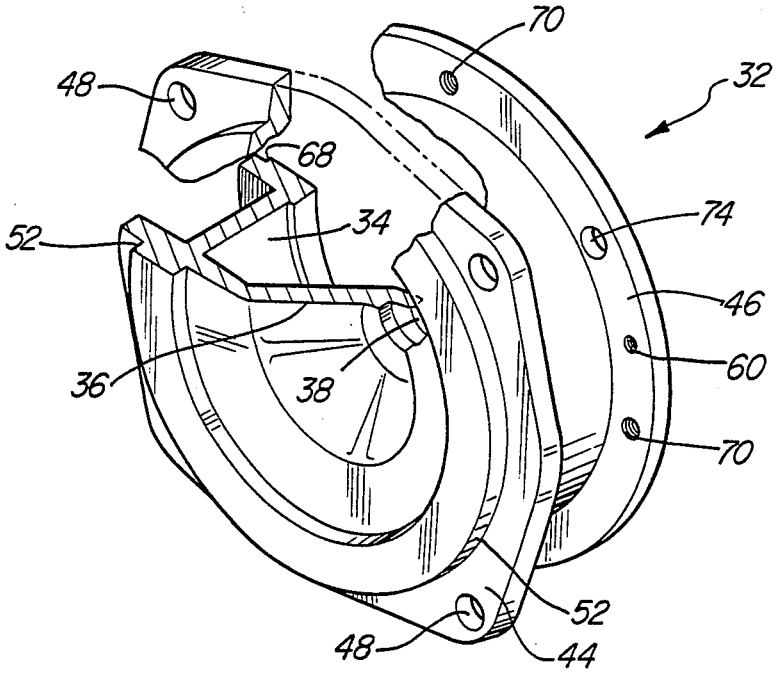
FIG. 3 is an elevated perspective view of the mounting bracket of the present invention.

Referring to FIGS. 1 and 3, the annular mounting ring 34 of the mounting bracket 32 includes a first mounting flange 44 for securing one end of the bracket 32 to the pump assembly 20 and a second mounting flange 46 for securing the other end of the bracket 32 to one of the motor assemblies 100 or 200. The first mounting flange 44 includes a plurality of mounting holes 48 adapted to receive bolts 50 for securing the bracket 32 to the pump assembly 20. In addition, the first flange 44 includes an outer annular rabbet 52 which provides proper alignment and a mating seal between the bracket 32 and the pump housing 22. An O-ring seal 54 is included to enhance the seal therebetween and prevent fluid leakage.

Connection of the bracket 32 and the pump assembly 20 to one of the partial motor assembly 100 and the full motor assembly 200 will now be described in greater detail.

The partial motor assembly 100 comprises a partial motor housing 102 including a generally tubular outer housing 104 and an end bell 106. The end of the partial motor housing 102 opposite the end bell 106 does not include an enclosing wall in order to eliminate the duplication of parts upon connection of the pump assembly 20 and bracket 32. In ths manner, overall weight and manufacturing costs are reduced by employing the partial motor assembly 100. A motor drive shaft 108 extends from the rotor of the motor (not shown) through the open end of the partial motor housing 102, through the hub 36 of the mounting bracket 32 and is drivably connected to the pump impeller 24 in a well-known manner.

In order to support the drive shaft 108 of the partial motor 100, a bearing housing 56 is mounted to the second flange 46 of the bracket 32. A plurality of bolts 58 extending through the bearing housing 56 and into a first set of apertures 60 formed in the second flange 46 are utilized to secure the bearing housing 56 to the bracket 32. The bearing housing 56, in turn, retains a bearing 62 within a central aperture 64 thereof. The bearing 62 is held in position by one or more bolts 66 which extend into the bearing housing 56. With the bearing housing 56 and bearing 62 secured to the mounting bracket 32, the partial motor assembly 100 can now be mounted to the second flange 46 of the mounting bracket 32.

Referring to FIGS. 1 and 3, the second flange 46 of the bracket 32 includes an outer annular rabbet 68 to properly align the bracket 32 with the housing wall 104. In the preferred embodiment, the bracket 32 is matingly received within the open end of the partial motor housing 102 so as to enclose the partial motor assembly 100. The second flange 46 also includes a second set of mounting apertures 70 for securing the partial motor assembly 100 ot the mounting bracket 32. The mounting apertures 70 threadably receive through-bolts 110 which are commonly found on both partial and full motor assemblies. The through-bolts 110 generally extend through the end bell 106 and the partial motor housing 102 to enclose the assembly using the bracket 32 and the bearing housing 56. Upon tightening of the through-bolts 110 the bracket 32 encloses the partial motor assembly 100.

Thus, the bracket 32 secures the pump assembly 20 to the partial motor assembly 100 which extends through the mounting bracket 32 to drivably engage the pump impeller 24. In the preferred embodiment, the bearing housing 56 is made of plastic to reduce the weight and cost of the entire assembly. However, in order to limit the axial movement of the bearing housing 56 along the drive shaft 108, the hub 36 of the bracket 32 includes a pair of limiting flanges 72 which engage the bearing housing 56 in the event that the axial or thrust forces generated by the impeller 24 cause the housing 56 to bend outwardly.

Although pump and partial motor assembly 100 is preferred from a manufacturing standpoint because of the savings in material costs and labor, in the event the parital motor assembly 100 fails, the entire assembly 10 must be replaced since the partial motor assembly 100 is not independently operable and therefore not readily available except directly from the original manufacturer. However, since the pump assembly 20 is still in operating condition, it is desirable to mount a readily available full motor assembly 200 to the pump assembly 20 and bracket 32 at a minimum of cost and labor.

Referring now to FIG. 2, the full motor assembly 200 comprises a full motor housing 202 including tubular side wall 204 and end walls 206 and 208 enclosing the full motor assembly. The full motor housing 202 is held together by through-bolts 210 which extend through the end wall 206 and the housing 202 to threadably engage the end wall 208. In this manner the full motor assembly 200 is a fully enclosed entity capable of independent operation. The bearing which supports the drive shaft (not shown) extending through the wall 208 is retained directly in the end wall 208 and therefore no separate bearing housing is necessary.

In order to secure the full motor assembly 200 to the bracket 32, the second flange 46 of the bracket 32 is provided with still a third set of mounting apertures 74. The apertures 74 receive mounting bolts 76 which extend therethrough and threadably engage the end wall 208 of the full motor housing 202. Preferably, four equally spaced apertures 74 and bolts 76 are provided. Upon removal of the bearing housing 56 from the bracket 32, the mounting bracket 32 may be utilized to connect the pump assembly 20 to the full motor assembly 200. In this manner, the bracket 32 may be used interchangeably between the partial motor assembly 100 and the full motor assembly 200.

Figure 4:
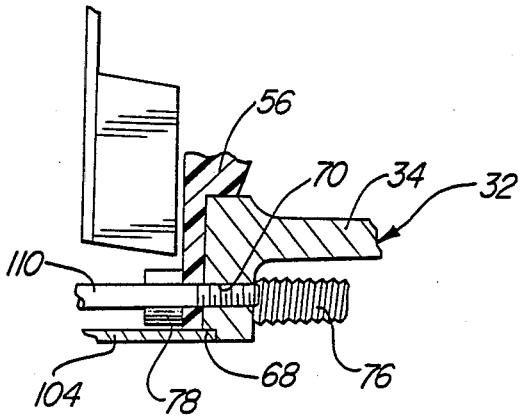
FIG. 4 is a partial sectional view of the mounting arrangement of the mounting bracket to the partial motor housing.

Referring now to FIGS. 1 and 4, as with most motor and pump assemblies 10, a support base 80 is provided for mounting the assembly 10 to a planar surface. However, the manner in which the support base 80 is secured to the assembly 10 is different depending upon the type of motor assembly used. In the full motor assembly 200 (FIG. 2), two of the four mounting bolts 76 are first extended through the support base 80 before they are placed through the mounting bracket 32 to threadably engage the end wall 208 of the full motor assembly 200. In this manner the support base 80 is secured to the motor and pump assembly 10. However, because of the different configuration of the partial motor assembly 200 securing the support base 80 to the partial motor housing is not possible. For this reason, the bearing housing 56 is provided with a pair of recessed cavities 78 which are adapted to receive the heads of the mounting bolts 76 thereby preventing their rotation during mounting of the support base 80. The recessed cavities 80 are aligned with the two bottom apertures 74 utilized to secure the mounting bracket 32 to the full motor assembly 200. Since these apertures 74 are not utilized to mount the partial motor assembly 100, they can be used to mount the assembly 10 to the identical support base 80. When the bolts 76 are disposed within the recessed cavity 78 of the bearing housing 56, the threaded end thereof extends through the apertures 74 formed in the bracket (FIG. 4) for secürement to the support base 80 as shown in FIG. 1 using nuts 82.

Thus, the mounting bracket 32 of the present invention provides a simple means of initially assembling a pump and motor assembly using a partial motor in order to reduce manufacturing costs and, upon failure of the motor, employ the pump in conjunction with a full motor assembly. In this manner, the initial cost savings are realized in manufacturing the device while the user is not required to replace the entire motor and pump assembly, as necessary in the past, upon failure of the motor. In addition, substantially the same mounting hardware can be utilized for both pump assemblies.

The foregoing detailed description has been given for clearness of understanding only and no unnecessary limitations should be understood therefrom as some modifications will be obvious to those skilled in the art without departing from the scope and spirit of the claims.

We claim:

1. An intermediate mounting bracket for connecting a pump assembly including a pump housing having an impeller rotatably disposed therein to one of a partial motor assembly and a full motor assembly, the partial motor assembly including a substantially tubular housing having an open end with a motor drive shaft extending therethrough and the full motor assembly including a substantially tubular housing having a pair of end walls with a motor drive shaft extending through one of the end walls, said mounting bracket comprising:

means for securing the pump assembly to a first side of said mounting bracket;

first means for securing the open end of the partial motor assembly to a second side of said mounting bracket, the drive shaft of the partial motor assembly extending from the partial motor housing through said bracket and drivably connected to the pump impeller; and second means for securing the full motor assembly to said second side of said mounting bracket, the drive shaft of the full motor assembly extending from the full motor housing through said bracket and drivably connected to the pump impeller;

wherein said bracket is adapted to connect the pump assembly to one of the partial motor assembly and the full motor assembly.

2. The mounting bracket as defined in claim 1 wherein said bracket comprises an annular mounting ring integrally formed with a support hub, said support hub having a throughbore adapted to receive said drive shaft extending through said mounting bracket.

3. The mounting bracket as defined in claim 2 wherein said annular mounting ring includes a first mounting flange for securing the pump assembly to said first side of said mounting bracket and a second mounting flange for securing one of the partial motor assembly and the full motor assembly to said second side of said mounting bracket.

4. The mounting bracket as defined in claim 3 wherein said first mounting flange includes a plurality of apertures, said means for securing the pump assembly to said first side of said mounting bracket comprises a corresponding plurality of pump mounting bolts extending through said apertures in said first mounting flange into the pump housing.

5. The mounting bracket as defined in claim 3 and further comprising a bearing housing secured to said second mounting flange of said mounting bracket, said bearing housing retaining bearing means adapted to rotatably receive the drive shaft of the partial motor assembly.

6. The mounting bracket as defined in claim 5 wherein said first means for securing the partial motor assembly to said second side of said mounting bracket comprises a plurality of throughbolts extending through the partial motor assembly and a corresponding plurality of first mounting apertures formed in said second mounting flange of said bracket to secure said mounting bracket and bearing housing to the partial motor housing, said mounting bracket enclosing the end of the partial motor housing.

7. The mounting bracket as defined in claim 6 wherein said bearing housing includes at least one recessed cavity, said at least one cavity adapted to non-rotatably receive the head of a base mounting bolt, said base mounting bolt extending through said mounting bracket to secure said mounting bracket and partial motor assembly to a support base, said cavity preventing rotation of said base mounting bolt during securing of said support base.

8. The mounting bracket as defined in claim 6 wherein said second mounting flange of said bracket includes a peripheral rabbet, said rabbet adapted to matingly cooperate with the open end of the partial motor housing to secure said mounting bracket to the partial motor assembly and enclose the partial motor housing.

9. The mounting bracket as defined in claim 5 wherein said support hub of said mounting bracket includes at least one rib extending from said support hub and engageable with said bearing housing to prevent axial flexular movement of said bearing housing.

10. The mounting bracket as defined in claim 3 wherein said second means for securing the full motor assembly to said second side of said mounting bracket comprises a plurality of mounting bolts extending through a corresponding plurality of second mounting apertures formed in said second mounting flange of said bracket into the end wall of the full motor assembly to secure said bracket to the end wall of the full motor assembly such that the drive shaft extends through said mounting bracket.

11. The mounting bracket as defined in claim 10 wherein at least one of said mounting bolts secures the full motor assembly and said intermediate bracket to a support base.

12. An intermediate mounting bracket for connecting a pump assembly including a pump housing having an impeller rotatably disposed therein to one of a partial motor assembly and a full motor assembly, the partial motor assembly including a substantially tubular housing having an end wall and an open end with a motor drive shaft extending from the housing through the open end, and the full motor assembly including a substantially tubular housing having a pair of end walls with a motor drive shaft extending from the housing through one of the end walls, said mounting bracket comprising:

means for securing the pump assembly to a first side of said mounting bracket, said first side of said mounting bracket includes a first mounting flange having a plurality of apertures, said means for securing the pump assembly comprises a corresponding plurality of pump mounting bolts extending through said apertures in said first mounting flange into the pump housing;

first means for securing the partial motor assembly to a second side of said mounting bracket, said mounting bracket secured to the open end of the partial motor housing to enclose the partial motor assembly wherein the drive shaft extends through said mounting bracket, said second side of said mounting bracket includes a second mounting flange having a first plurality of apertures, said first means for securing the partial motor assembly comprises a corresponding plurality of throughbolts extending through the partial motor assembly into said first plurality of apertures; and second means for securing the full motor assembly to said second side of said mounting bracket, said mounting bracket secured to one end wall of the full motor housing wherein the drive shaft extends through said mounting bracket, said second mounting flange of said mounting bracket having a second plurality of apertures, said second means for securing the full motor assembly comprises a corresponding plurality of mounting bolts extending through said second plurality of apertures into the end wall of the full motor assembly;

wherein said bracket is adapted to connect the pump assembly to one of the partial motor assembly and the full motor assembly, the drive shaft being drivably connected to the pump impeller.

13. The mounting bracket as defined in claim 12 wherein said mounting bracket comprises an annular mounting ring integrally formed with a support hub having a throughbore adapted to receive the drive shaft extending through said mounting bracket, said mounting ring including said first mounting flange formed on said first side of said bracket and said second mounting flange formed on said second side of said bracket.

14. The mounting bracket as defined in claim 13 and further comprising a bearing housing secured to said mounting bracket for retaining bearing means adapted to rotatably receive the drive shaft of said partial motor assembly, said second flange of said mounting bracket including an inner annular rabbet adapted to align and receive said bearing housing within the end of the partial motor housing.

15. The mounting bracket as defined in claim 13 wherein said second flange of said bracket includes an outer annular rabbet adapted to align said bracket and bearing housing within the open end of the partial motor housing.

16. The mounting bracket as defined in claim 13 wherein said bearing housing includes at least one recessed cavity, said at least one cavity adapted to receive the head of a base mounting bolt, said base mounting bolt extending through said mounting bracket to secure the partial motor and pump assembly to a support base, said cavity preventing rotation of said mounting bolt.

17. The mounting bracket as defined in claim 14 wherein said support hub of said mounting bracket includes rib means for preventing resilient axial movement of said bearing housing along the drive shaft.

18. In a pump and motor assembly comprising a pump assembly including a pump housing having an impeller rotatably disposed therein, a mounting bracket for connecting the pump assembly to one of a partial motor assembly and a full motor assembly, the partial motor assembly including a substantially tubular housing having an open end with a motor drive shaft extending therethrough and the full motor assembly including a substantially tubular housing having a pair of end walls with a motor drive shaft extending through one of the end walls, said mounting bracket comprising:

an annular mounting ring having first and second mounting flanges formed at opposite ends thereof, said first mounting flange including means for securing the pump assembly to said mounting bracket and said second mounting flange including first means for securing the partial motor assembly to said mounting bracket and second means for securing the full motor assembly to said mounting bracket;

a support hub integrally formed with said mounting ring, said hub including a central opening adapted to receive a drive shaft extending through said mounting bracket and drivably connected to the pump impeller;

said first means for securing the partial motor assembly to said mounting bracket comprises a first plurality of apertures formed in said second mounting flange and adapted to receive throughbolts extending through the partial motor assembly, said mounting bracket matingly received within the open end of the partial motor housing thereby enclosing the partial motor assembly; and said second means for securing the full motor assembly to said mounting bracket comprises a second plurality of apertures formed in said second mounting flange and adapted to receive mounting bolts, said second flange being secured directly to one of the end walls such that the drive shaft extends through said mounting bracket;

wherein the pump impeller is drivably connected to the drive shaft of one of the partial motor assembly and the full motor assembly.

19. The mounting bracket as defined in claim 18 wherein a bearing housing is attached to said second mounting flange to support the drive shaft of the partial motor assembly, said bearing housing includes at least one recessed cavity to non-rotatably receive a base mounting bolt, said base mounting bolt extending through said second flange of said bracket to secure said mounting bracket and partial motor assembly to a support base, said cavity preventing rotation of said base mounting bolt during securing of said support base.

* * * * *